US007857415B2

(12) United States Patent
Ikeda et al.

(10) Patent No.: US 7,857,415 B2
(45) **Date of Patent: *Dec. 28, 2010**

(54) INK TANK POSITION DETECTION METHOD

(75) Inventors: Yasuhiko Ikeda, Sagamihara (JP); Mitsuyuki Fujibayashi, Kawasaki (JP); Akira Kuribayashi, Kawasaki (JP); Takayuki Ochiai, Inagi (JP); Kenji Kitabatake, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/391,072

(22) Filed: Feb. 23, 2009

(65) Prior Publication Data

US 2009/0162079 A1 Jun. 25, 2009

Related U.S. Application Data

(63) Continuation of application No. 11/424,940, filed on Jun. 19, 2006, now Pat. No. 7,513,591.

(30) Foreign Application Priority Data

Jun. 21, 2005 (JP) ..... 2005-180556

(51) Int. Cl.
*B41J 29/393* (2006.01)

(52) U.S. Cl. ..... 347/19; 347/5; 347/9

(58) Field of Classification Search ..... 347/5, 347/9, 19, 86, 7, 12, 14
See application file for complete search history.

(56) References Cited

U.S. PATENT DOCUMENTS

2005/0219303 A1 * 10/2005 Matsumoto et al. ..... 347/19

* cited by examiner

*Primary Examiner*—Lam S Nguyen
(74) *Attorney, Agent, or Firm*—Canon U.S.A., Inc. I.P. Division

(57) ABSTRACT

A recording apparatus including a movable carriage, wherein a plurality of mounting positions are arranged in a moving direction of the carriage, a light receiving portion capable of receiving light emitted by a light emitting portion of a plurality of liquid containers, a determining means for determining whether a correct liquid container is mounted at a mounting position based on a light receiving amount received by the light receiving portion, and a specifying means for specifying an incorrectly mounted liquid container based on the light receiving amount received by the light receiving portion, wherein the specifying means stops the carriage such that any mounting position with the incorrectly mounted liquid container is opposite the light receiving portion, and wherein if a plurality of liquid containers are determined to be incorrectly mounted, the light emitting portion of the incorrectly mounted liquid containers emit light in a specific order.

5 Claims, 14 Drawing Sheets

LIGHT-EMITTING TANK

→ POSITION

| | K | C | M | Y |
|---|---|---|---|---|
| K | 563 | | | |
| C | 14 | 62 | | |
| M | | | | |
| Y | | | | |

LIGHT-EMITTING TANK

→ POSITION

| | K | C | M | Y |
|---|---|---|---|---|
| K | 563 | 110 | | |
| C | 14 | 62 | | |
| M | | | | |
| Y | | | | |

LIGHT-EMITTING TANK

→ POSITION

| | K | C | M | Y |
|---|---|---|---|---|
| K | 563 | 110 | | |
| C | 14 | 62 | | |
| M | | 67 | | |
| Y | | | | |

→ POSITION

LIGHT-EMITTING TANK ↓

| | K | C | M | Y |
|---|---|---|---|---|
| K | 563 | 110 | | |
| C | 14 | 62 | | |
| M | | 67 | 323 | |
| Y | | | | |

→ POSITION

LIGHT-EMITTING TANK ↓

| | K | C | M | Y |
|---|---|---|---|---|
| K | 563 | 110 | | |
| C | 14 | 62 | 13 | |
| M | | 67 | 323 | |
| Y | | | | |

→ POSITION

LIGHT-EMITTING TANK ↓

| | K | C | M | Y |
|---|---|---|---|---|
| K | 563 | 110 | | |
| C | 14 | 62 | 13 | |
| M | | 67 | 323 | |
| Y | | | 146 | |

LIGHT-EMITTING TANK

→ POSITION

| | K | C | M | Y |
|---|---|---|---|---|
| K | 563 | 110 | | |
| C | 14 | 62 | 13 | |
| M | | 67 | 323 | |
| Y | | | 146 | 663 |

LIGHT-EMITTING TANK

→ POSITION

| | K | C | M | Y |
|---|---|---|---|---|
| K | 563 | 110 | | |
| C | 14 | 62 | 13 | |
| M | | 67 | 323 | 68 |
| Y | | | 146 | 663 |

LIGHT-EMITTING TANK

→ POSITION

| | K | C | M | Y |
|---|---|---|---|---|
| K | 563 | | | |
| C | 1 | 14 | | |
| M | | | | |
| Y | | | | |

LIGHT-EMITTING TANK

→ POSITION

| | K | C | M | Y |
|---|---|---|---|---|
| K | 563 | 110 | | |
| C | 1 | 14 | | |
| M | | | | |
| Y | | | | |

LIGHT-EMITTING TANK

→ POSITION

| | K | C | M | Y |
|---|---|---|---|---|
| K | 563 | 110 | | |
| C | 1 | 14 | | |
| M | | 3 | | |
| Y | | | | |

→ POSITION

LIGHT-EMITTING TANK ↓

| | K | C | M | Y |
|---|---|---|---|---|
| K | 563 | 110 | | |
| C | 1 | 14 | | |
| M | | 3 | 15 | |
| Y | | | | |

→ POSITION

LIGHT-EMITTING TANK ↓

| | K | C | M | Y |
|---|---|---|---|---|
| K | 563 | 110 | | |
| C | 1 | 14 | 256 | |
| M | | 3 | 15 | |
| Y | | | | |

→ POSITION

LIGHT-EMITTING TANK ↓

| | K | C | M | Y |
|---|---|---|---|---|
| K | 563 | 110 | | |
| C | 1 | 14 | 256 | |
| M | | 3 | 15 | |
| Y | | | 48 | |

→ POSITION

LIGHT-EMITTING TANK ↓

| | K | C | M | Y |
|---|---|---|---|---|
| K | 563 | 110 | | |
| C | 1 | 14 | 256 | |
| M | | 3 | 15 | |
| Y | | | 48 | 6 |

→ POSITION

LIGHT-EMITTING TANK ↓

| | K | C | M | Y |
|---|---|---|---|---|
| K | 563 | 110 | | |
| C | 1 | 14 | 256 | |
| M | | 3 | 15 | 323 |
| Y | | | 48 | 6 |

→ POSITION

| LIGHT-EMITTING TANK ↓ | K | C | M | Y |
|---|---|---|---|---|
| K | | | | |
| C | | | | |
| M | | | | |
| Y | | | | 6 |

→ POSITION

| LIGHT-EMITTING TANK ↓ | K | C | M | Y |
|---|---|---|---|---|
| K | | | | |
| C | | | | |
| M | | | | 323 |
| Y | | | | 6 |

→ POSITION

| LIGHT-EMITTING TANK ↓ | K | C | M | Y |
|---|---|---|---|---|
| K | | | | |
| C | | | | 86 |
| M | | | | 323 |
| Y | | | | 6 |

→ POSITION

| LIGHT-EMITTING TANK ↓ | K | C | M | Y |
|---|---|---|---|---|
| K | | | | |
| C | | | | |
| M | | | 15 | |
| Y | | | | |

→ POSITION

| LIGHT-EMITTING TANK ↓ | K | C | M | Y |
|---|---|---|---|---|
| K | | | | |
| C | | | 256 | |
| M | | | 15 | |
| Y | | | | |

→ POSITION

| LIGHT-EMITTING TANK ↓ | K | C | M | Y |
|---|---|---|---|---|
| K | | | | |
| C | | | 256 | |
| M | | | 15 | |
| Y | | | 48 | |

→ POSITION

LIGHT-EMITTING TANK ↓

| | K | C | M | Y |
|---|---|---|---|---|
| K | | | | |
| C | | | | 86 |
| M | | | | 323 |
| Y | | | | 6 |

→ POSITION

LIGHT-EMITTING TANK ↓

| | K | C | M | Y |
|---|---|---|---|---|
| K | 563 | 110 | | |
| C | 1 | 14 | 256 | |
| M | | 3 | 15 | |
| Y | | | 48 | |

→ POSITION

LIGHT-EMITTING TANK ↓

| | K | C | M | Y |
|---|---|---|---|---|
| K | 563 | 110 | | |
| C | 1 | 14 | 256 | |
| M | | 3 | 15 | |
| Y | | 560 | 48 | |

INK TANK POSITION DETECTION METHOD

CROSS-REFERENCE TO RELATED APPLICATIONS

This application is a continuation of U.S. patent application Ser. No. 11/424,940, filed on Jun. 19, 2006, which claims priority to Japanese Patent Application No. 2005-180556, filed Jun. 21, 2005, all of which are hereby incorporated by reference herein in its entirety.

BACKGROUND OF THE INVENTION

1. Field of the Invention

The present invention relates to a position detection method, and relates particularly to a position detection method that permits a recording apparatus to identify a position at which to mount an ink tank.

2. Description of the Related Art

Recently, to respond to requests for further increases in image quality, inks having low densities, such light magenta and light cyan, have begun to be employed in addition to inks in the conventional four colors (black, yellow, magenta and cyan). Furthermore, the use of special ink colors, such as red and blue, has been proposed. In such a case, seven to eight ink tanks are separately mounted on an ink jet printer, and for this, a mechanism for preventing the mounting of an ink tank in an incorrect position is required. One arrangement is disclosed in Japanese Patent Laid-Open Publication No. 2004-276291. According to this arrangement, optical paths are formed in the individual ink tanks, and when the ink tanks are mounted correctly, the optical paths are linearly formed, permitting light to be transmitted from light emitting sources to light receiving portions. Thus, when one of the ink tanks is incorrectly positioned and mounted, light can not reach the light receiving portion, and thus the incorrect positioning of the ink tank can be detected. As described above, the arrangement wherein different paths are formed for ink tanks for individual colors is provided in order to identify the position where an ink tank is mounted. However, in this case, depending on the ink colors or ink types, ink tanks having different shapes must be produced. This increases manufacturing efficiency and costs. Furthermore, although this arrangement can detect whether all ink tanks are normally mounted, it can not detect which ink tanks are incorrectly mounted or the positions at which they are mounted.

In another conventional example, an arrangement is proposed whereby a circuit is formed by connecting an electrical contact point for each ink tank to a corresponding electrical contact point on the main body at a location where, for example, a carriage. The signal lines for these circuits are regarded as separate lines for individual mounting positions. In this instance, ink color information for each ink tank is read from the ink tank, and a signal line for turning on an LED is provided as a separate line for each mounting position. With this arrangement, when the color information obtained through reading does not match the mounting position, it can be ascertained that the corresponding ink tank is incorrectly mounted.

Even though the arrangement whereby signal lines are employed separately for individual ink tanks or individual mounting positions enables determination that an ink tank is incorrectly mounted, it increases the number of signal lines in use. And as described above, for the latest types of ink jet printers, one of the trends is an increase in the number of ink types employed in order to improve the image quality, an increase in the number of signal lines increases manufacturing costs. To reduce the number of wiring lines, the employment of a so-called common signal line arrangement, such as a bus connection, is effective. However, neither the ink tank nor the mounting position for it can be identified by employing an arrangement that simply uses a common signal line, such as a bus connection.

Therefore, a position detection method has been proposed whereby by employing a common signal line, light emission control, such as LED control, is performed for mounting positions for a plurality of ink tanks. A light receiving portion is employed to enable identification of the mounting positions of fluid containers, such as the ink tanks. However, according to this connection arrangement, although a light emission signal is output for each of the ink tanks, from this alone it can not be ascertained for which ink tank at which position light is being emitted. In order to avoid this problem, the light emission operation and detection operation can be sequentially performed. That is, during a single detection operation, light emission is performed for an ink tank to identify its position, and subsequently, the succeeding ink tank detection operation is performed.

However, for a recording apparatus mounting ink tanks for multi colors, an extended period of time is required to complete the above described detection processing. For example, for a recording apparatus on which ink tanks are mounted for eight colors, approximately ten seconds is required for the performance of eight repetitious detection operations. As a result, the user is presented with an undesirable printing wait period.

SUMMARY OF THE INVENTION

According to an aspect of the present invention, a movable carriage, wherein a plurality of mounting positions are arranged in a moving direction of the carriage, a light receiving portion capable of receiving light emitted by a light emitting portion of a plurality of liquid containers, a determining means for determining whether a correct liquid container is mounted at a mounting position based on a light receiving amount received by the light receiving portion, and a specifying means for specifying an incorrectly mounted liquid container based on the light receiving amount, wherein the specifying means stops the carriage such that any mounting position with the incorrectly mounted liquid container is opposite the light receiving portion, and wherein if a plurality of liquid containers are determined to be incorrectly mounted, the light emitting portion of the incorrectly mounted liquid containers emit light in a specific order.

According to another aspect of the present invention, a recording apparatus includes a movable carriage, wherein a plurality of mounting positions are arranged in a moving direction of the carriage, a light receiving portion capable of sequentially receiving light emitted by a light emitting portion of a plurality of liquid containers, a determining means for determining whether a correct liquid container is mounted at a predetermined mounting position based on a light receiving amount sequentially received by the light receiving portion, and a specifying means for specifying when an incorrect liquid container is mounted at a predetermined mounting position, wherein the specifying means stops the carriage such that any mounting position with an incorrectly mounted liquid container is opposite the light receiving portion, and wherein the specifying means, based on the light receiving amount, specifies incorrectly mounted liquid containers by having light emitting portions of a plurality of liquid containers emit light in sequence.

Further features of the present invention will become apparent from the following description of exemplary embodiments (with reference to the attached drawings).

DESCRIPTION OF THE EMBODIMENTS

First Embodiment

Figure 13:
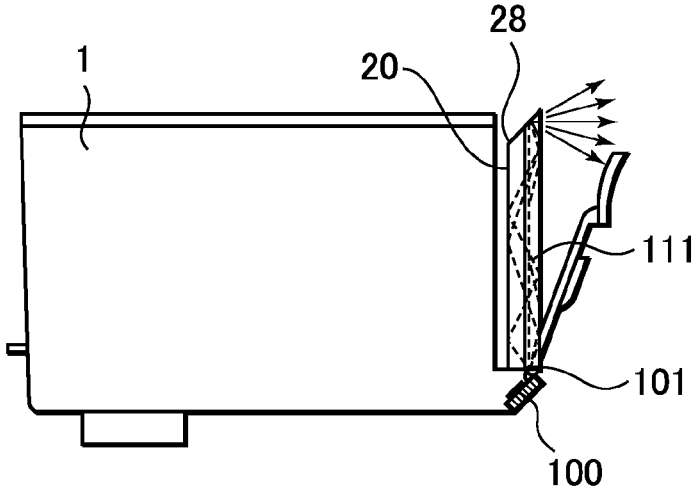
FIG. 13 is a side view of an ink tank according to the first embodiment of the invention.

FIG. 13 is a side view of the arrangement of an ink tank according to a first embodiment of the present invention. A substrate 100 on which an LED 101 is mounted is attached to an ink tank 1. Light emitted by the LED 101 is guided through a light guidance unit 20, and is reflected by an inclined plane 28. In this manner, a light path 111 is formed that radiates light to the right of the ink tank 1 in FIG. 13.

Figure 14:
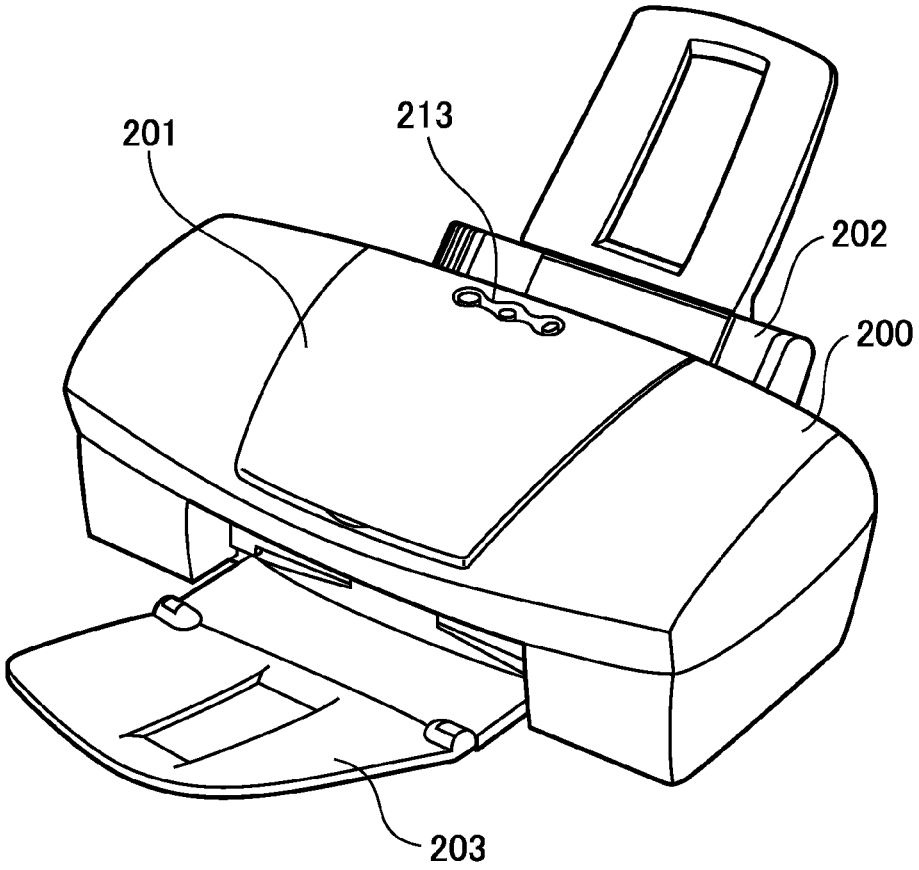
FIG. 14 is a perspective view of the external appearance of an inkjet printer with the ink tank mounted that performs recording according to the first embodiment.
Figure 15:
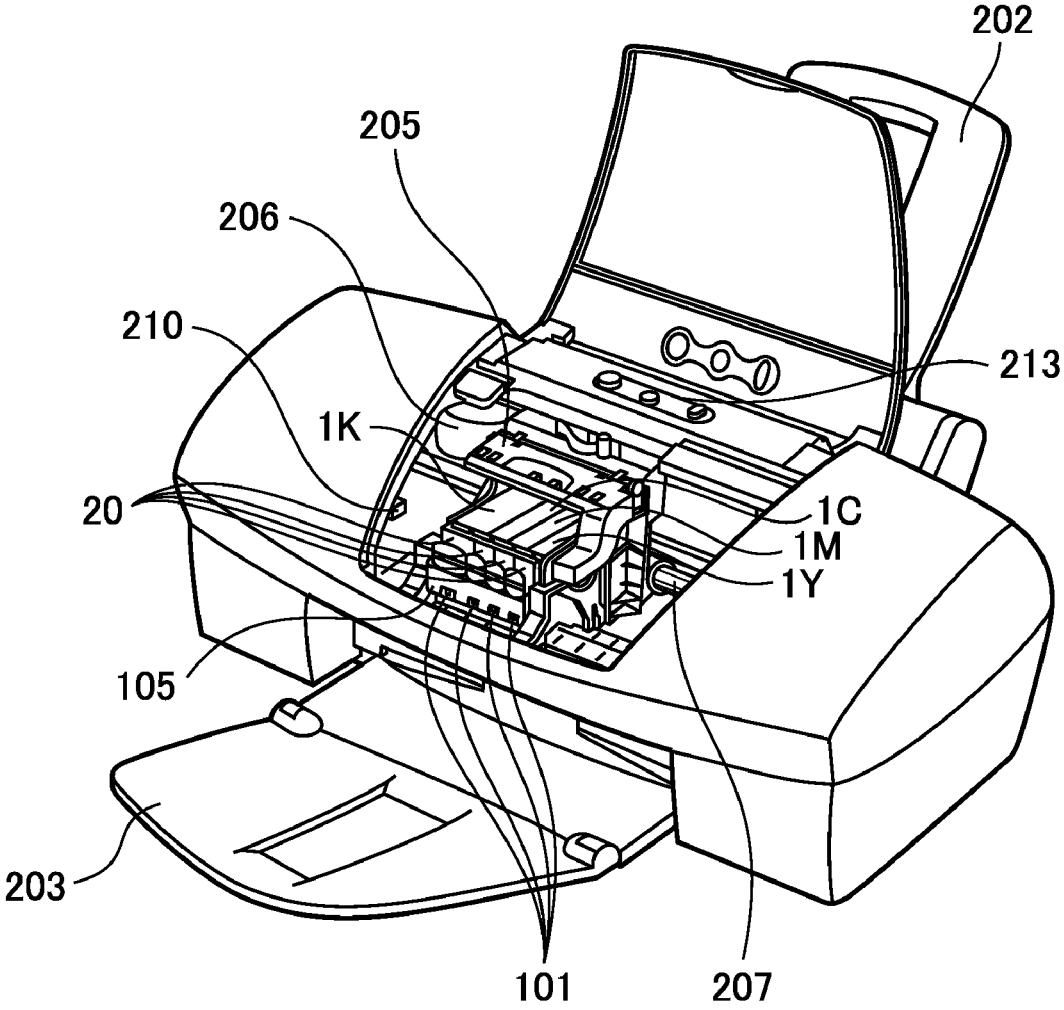
FIG. 15 is a perspective view of the inkjet printer with a main body cover in FIG. 14 open.

FIG. 14 is a diagram showing the external appearance of an inkjet printer (hereinafter referred to "printer") 200 that performs recording with the ink tank 1 mounted. FIG. 15 is a perspective view of the printer 200 with a main body cover 201 (in FIG. 14) open.

As shown in FIG. 14, the printer 200 includes a printer main body, which is the main printer portion and which includes a mechanism that performs scanning by moving a carriage whereon a recording head and ink tanks are mounted, covered by the main body cover 201 and other case portions, discharge tray 203, and automatic sheet feeder (ASF) 202, which are respectively located in the front and rear of the printer main body. In addition, an operation panel 213 is provided that includes a display device for displaying the state of the printer 200, both when the main body cover 201 is open and closed, a power switch and a reset switch.

When the main body cover 201 is open, as shown in FIG. 15, a user can see the range of travel and the peripheral portion of a carriage 205 on which are mounted a recording head unit 105 and ink tanks 1K, 1C, 1M and 1Y (hereinafter these ink tanks are collectively referred to as ink tanks 1). When the main body cover 201 is opened, a processing sequence is performed to automatically move the carriage 205 to approximately the center of the opening (hereinafter referred to as the "tank exchange position") so that the user can replace ink tanks at the tank exchange position.

In the printer 200 of this embodiment, chip-shaped recording heads (not shown) associated with individual ink colors are provided for the recording head unit 105. As the carriage 205 is moved, these recording heads scan a recording material, such as a sheet of paper, and while scanning, discharge ink onto the recording material to perform recording. That is, the carriage 205 engages and slides along a guide shaft 207 that is extended in the direction of movement, and can travel in the above described manner by using a carriage motor and a drive force transmission mechanism (not shown). The recording heads associated with K, C, M and Y inks discharge ink based on ink discharge data received from the control circuit in the main body through a flexible cable 206. Furthermore, a sheet feeding mechanism (not shown), including a convey roller and a delivery roller, is provided, and a recording material (not shown) fed from the automatic sheet feeder 202 can be conveyed to the discharge tray 203. In addition, the recording head unit 105, integrally formed with an ink tank holder, is detachably mounted on the carriage 205, while the ink tanks 1 are detachably mounted on the recording head unit 105.

During a recording operation, the recording heads perform scanning as the carriage 205 is moved in the above described manner, and discharge ink onto the recording material to record an area for which the width corresponds to the area of the discharge ports of the recording heads. Further, between the current scanning and the subsequent scanning, the sheet feeding mechanism feeds the recording material a predetermined distance in accordance with the above described width, and recording is thus sequentially performed on the recording material. Further, at the end of the range within which the recording heads are moved, a discharge recovery unit (not shown), such as a cap for covering the face wherein the discharge ports are formed, is provided for each recording head. At a predetermined time interval, the recording heads are moved to the position where the recovery units are located, and a recovery process, such as a preliminary discharge, is performed.

Connectors corresponding to the ink tanks 1 are provided for the recording head unit 105 that includes a tank holder for carrying the ink tanks 1. These connectors contact the pads of substrates provided for the ink tanks 1 that are to be mounted. As a result, turning on and off of the individual LEDs 101 is enabled.

More specifically, at the tank exchange position, when the remaining ink is low in an ink tank 1, the LED 101 of the pertinent ink tank 1 is either turned on or off. With this arrangement, the user, while viewing the ink tank 1 from above the printer 200, can identify the light emitted by the LED 101 and guided through the light guidance unit 20.

Further, within the range traveled by the carriage 205, a light receiving unit 210, which includes a light receiving portion, is located near the end opposite the position where the above described recovery units are located. Thus, when the LEDs 101 of the ink tanks 1 pass the light receiving unit 210 as the carriage 205 is moved, light is emitted by the LEDs 101 and is received by the light receiving unit 210. Then, based on the position of the carriage 205 at this time, the positions of the individual ink tanks 1 mounted on the carriage 205 can be detected. In another example of turning on the LEDs, when an ink tank 1 is correctly attached at the tank exchange position, the LED 101 of the ink tank 1 is turned on. This control process, as well as the ink discharge process of the recording head, is performed by the transmission, via the flexible cable 206, of control data (e.g., control signals) from the main body control circuit to the ink tanks 1.

Figure 16:
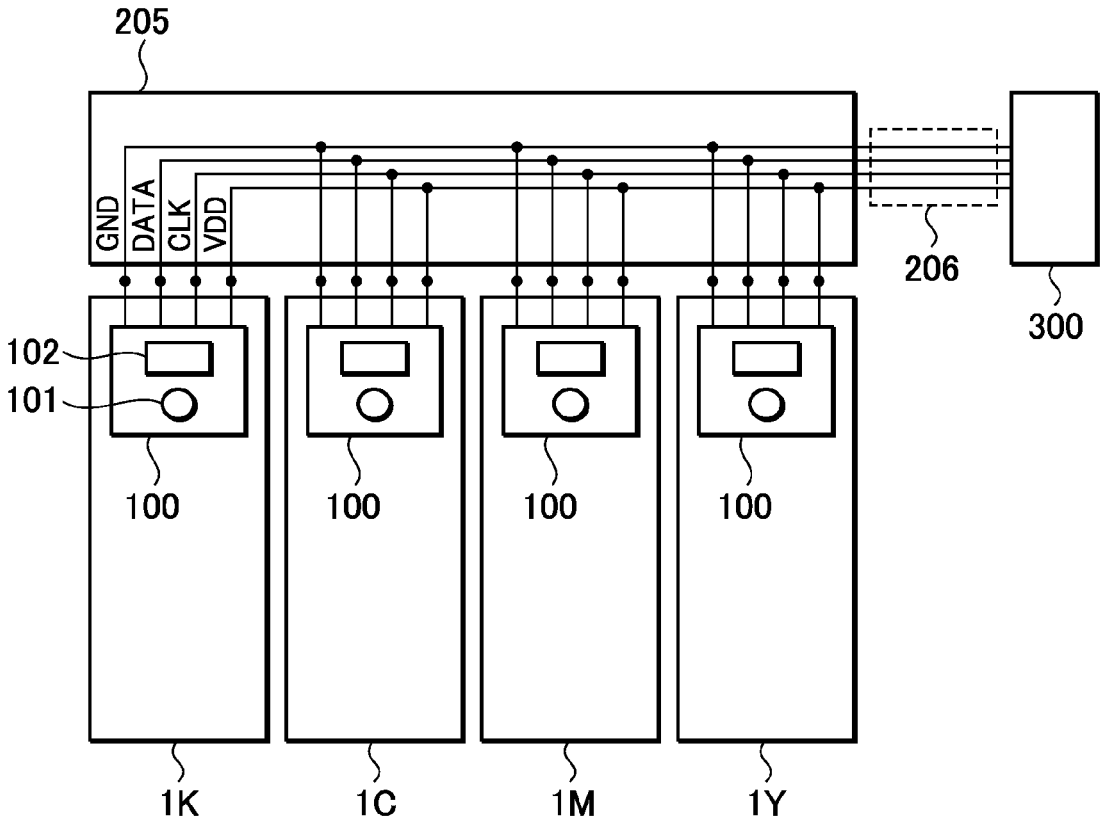
FIG. 16 is a diagram showing an exemplary arrangement of signal lines, relative to substrates of individual ink tanks, in order that signals can be exchanged with ink tanks in the inkjet printer for the first embodiment.

FIG. 16 is a diagram showing signal wiring for the flexible cable 206, relative to substrates 100 of the individual ink tanks 1, for the signal connection of the ink tanks 1 with a control circuit 300.

As shown in FIG. 16, the signal wiring for the ink tanks 1 includes four signal lines, and is used in common for the four ink tanks 1 (a so-called bus connection). That is, the signal wiring provided for the ink tanks 1 includes a power signal line VDD, for supplying power for the emission of light by the LEDs 101 of the ink tanks 1 and for the operation of function devices, in IC packages 102, that drive the LEDs 101, a ground signal line GND, a signal line DATA, for the transmission from the control circuit 300, of control signals (e.g., control data) related to a process for turning on or off the LEDs 101, which will be described later, and a clock signal line CLK.

While the present embodiment employs four signal lines, the present invention is not limited to four and any arrangement enabling practice of the invention is applicable. For example, a ground signal may be transmitted via another arrangement instead of using the GND line. In another example, a single signal line may be employed for both CLK and DATA signals. According to this arrangement, a signal line DATA need not be provided for each ink tank, and the number of signal lines in the flexible cable 206 can be reduced. In this embodiment, a printer 200 is employed wherein ink tanks for four colors are mounted. When a printer is employed wherein, for example, ink tanks for eight colors are mounted and a signal line DATA is arranged for each ink tank, a total of eleven signal lines, i.e., a power signal line VDD, a ground signal line GND, a clock signal line CLK and eight control signal lines DATA, are required. As a result, the wiring for the flexible cable 206 becomes overly complicated, and its manufacturing cost is increased. Therefore, cost wise, the above described bus connection is beneficial for a printer wherein ink tanks are mounted for a plurality of colors.

The control circuit 300 performs data processing and provides control for the operation of the printer 200. The control circuit 300 includes a CPU, a ROM, for storing a program provided for the operation of the printer 200, and a RAM, for use as a work area.

FIGS. 1 to 4 are schematic diagrams showing the position detection processing according to the first embodiment of the present invention. When the power to the printer 200 is turned on, or when the ink tanks 1 are exchanged, the processing is performed sequentially, from FIG. 1A to FIG. 4B. The carriage 205 has four positions, i.e., from the left, a black position (K), a cyan position (C), a magenta position (M) and a yellow position (Y), at which the black ink tank 1K (K), the cyan ink tank 1C (C), the magenta ink tank 1M (M) and the yellow ink tank 1Y (Y) are to be respectively mounted. Carriage 205 can be reciprocally moved along the guide shaft 207. The light receiving unit 210 is fixed to the printer main body (not shown). The light receiving unit 210 is, for example, a sensor constituted by a phototransistor, wherein a photocurrent is changed in accordance with the amount of light received.

Figure 17:
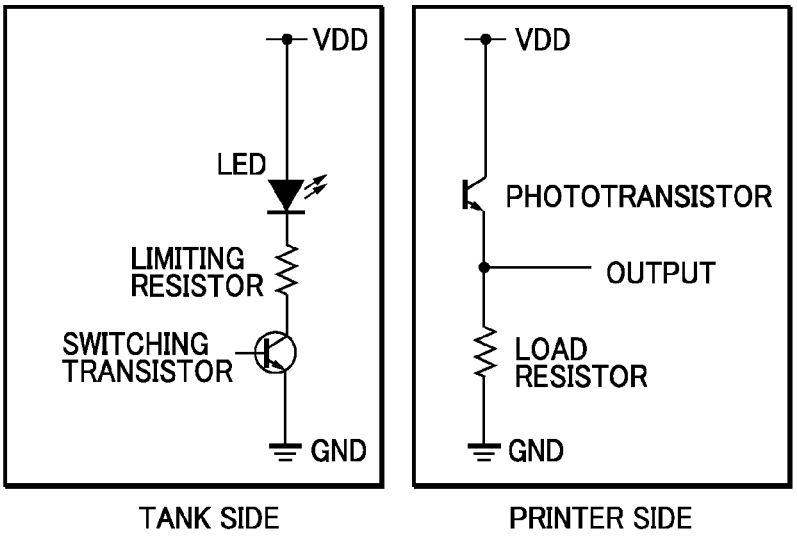
FIG. 17 is a circuit diagram showing a light emitting circuit for ink tanks and a light receiving circuit for a light receiving unit provided for the inkjet printer of the first embodiment.

In this embodiment, a circuit shown in FIG. 17 detects, as a voltage change, a change in a photocurrent, while VDD=3300 mV is employed as a reference potential and a load resistance of 150 kΩ is employed as an output potential. That is, the amount of light received is represented as a voltage. It should be noted that the state in FIGS. 1 to 4 represents a state wherein an ink tank 1 for a correct color is mounted at a predetermined position on the carriage 205. The emission of light by the LEDs 101, the detection of a photocurrent, in accordance with the amount of light received, the movement of the carriage 205, and the determination of the position of the ink tank 1, which will be described later, are controlled in accordance with the program stored in the ROM included in the control circuit 300.

Figure 1A:
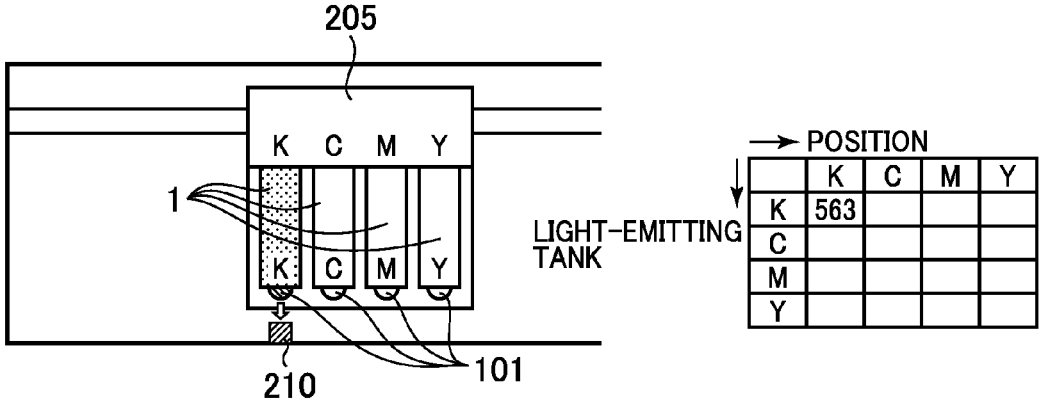
FIGS. 1A and 1B are schematic diagrams showing the position detection processing according to a first embodiment of the present invention.
Figure 1B:
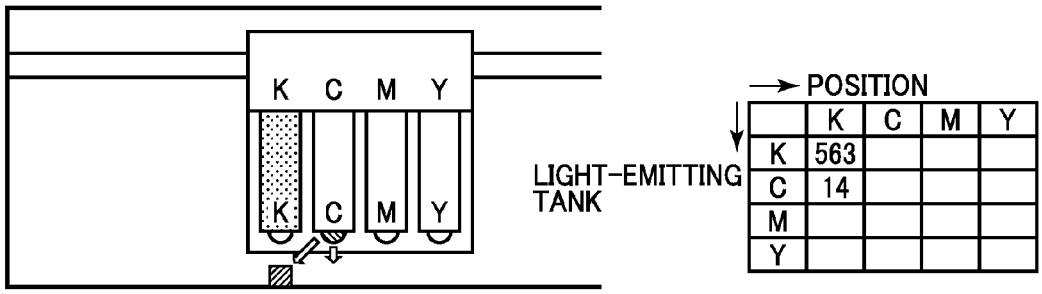

In the states in FIGS. 1A and 1B, the carriage 205 is moved so that the light receiving unit 210 faces the black position (K). In the state in FIG. 1A, the LED 101 for the black ink tank 1K is turned on, and the amount of light received by the light receiving unit 210 is 563 mV. In the state in FIG. 1B, the LED 101 for the black ink tank 1K is turned off and the LED 101 for the cyan ink tank 1C is turned on. At this time, the amount of light received by the light receiving unit 210 is 14 mV.

Figure 2A:
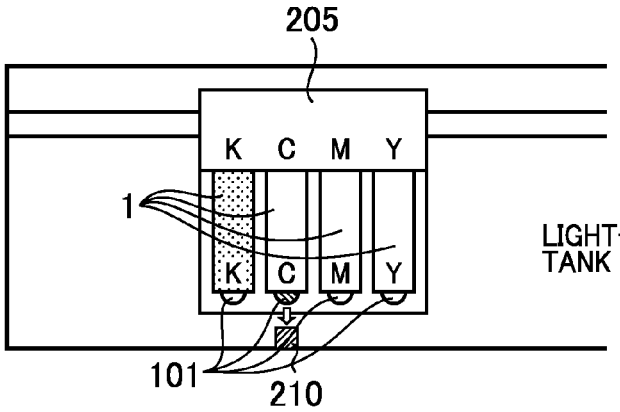
FIGS. 2A, 2B and 2C are diagrams showing the position detection processing according to the first embodiment of the invention.
Figure 2B:
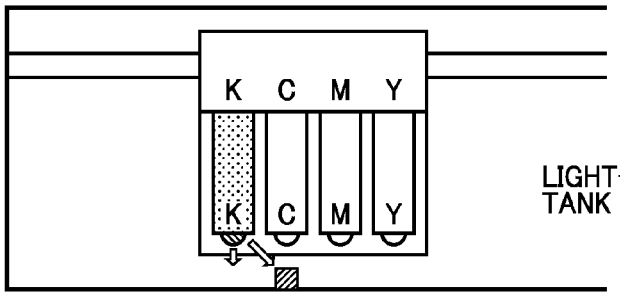
Figure 2C:
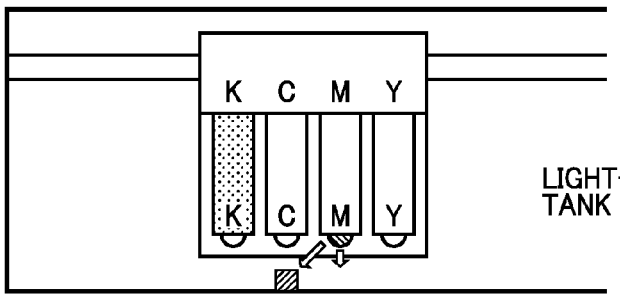

FIGS. 2A to 2C are diagrams showing the states wherein the position of the carriage 205 is shifted to the left a distance equivalent to one ink tank, i.e., the light receiving unit 210 faces the cyan position (C). In the state shown in FIG. 2A, the carriage 205 is moved while the LED 101 for the cyan ink tank 1C in FIG. 1B remains on. Thus, since the LED 101 for the cyan ink tank 1C is still on, at this time, the amount of light received by the light receiving unit 210 is 62 mV.

In the state in FIG. 2B, while the carriage 205 has not been moved, the LED 101 for the cyan ink tank 1C is turned off and the LED 101 for the black ink tank 1K is turned on. At this time, the amount of light received by the light receiving unit 210 is 110 mV. In the state shown in FIG. 2C, the LED 101 for the black ink tank 1K is turned off and the LED 101 for the magenta ink tank 1M is turned on. At this time, the amount of light received by the light receiving unit 210 is 67 mV.

Figure 3A:
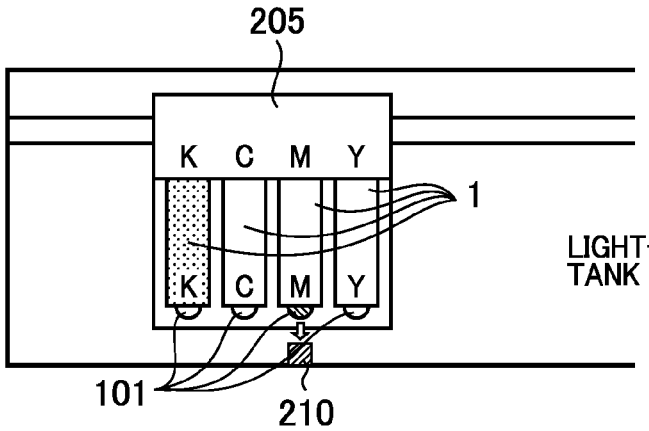
FIGS. 3A, 3B and 3C are diagrams showing the position detection processing according to the first embodiment of the invention.
Figure 3B:
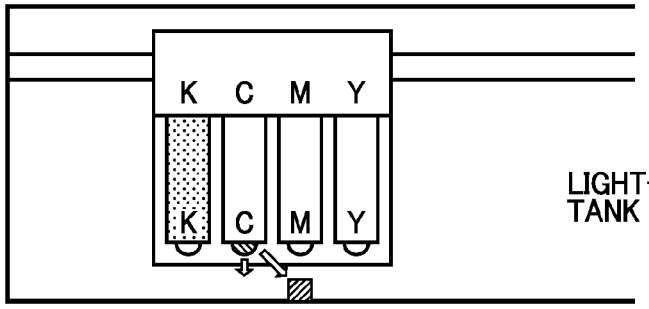
Figure 3C:
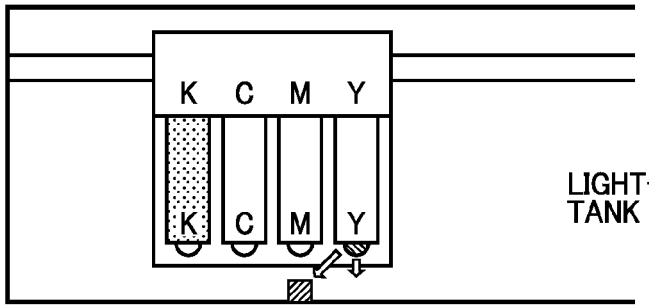
Figure 4A:
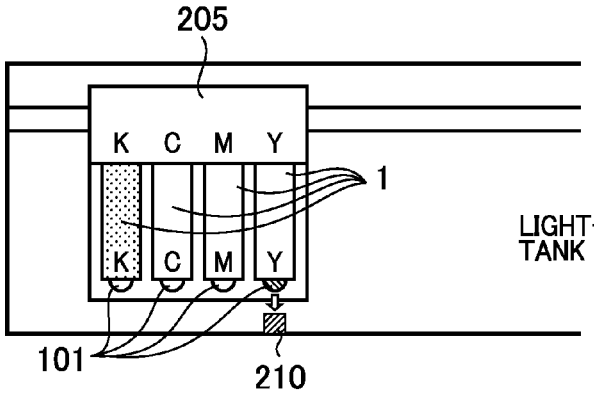
FIGS. 4A and 4B are diagrams showing the position detection processing according to the first embodiment of the invention.
Figure 4B:
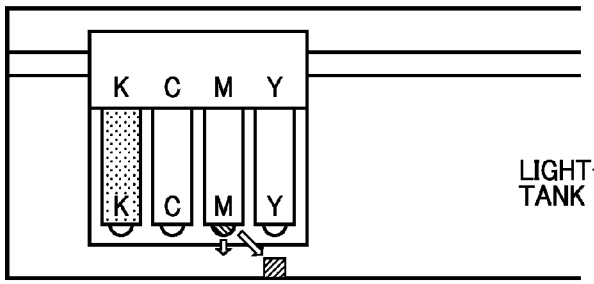

In FIGS. 3 and 4, in the same manner as in the above operation, the carriage 205 is moved and its position is shifted to the left a distance equivalent to one ink tank, and the adjacent ink tanks are alternately turned on. As a result, the amount of light that is received by the light receiving unit 210 located in front of an ink tank 1 that is mounted at a correct position, and the amount of light emitted by the LED 101 for the pertinent ink tank 1, when it is moved to the positions (or the position when the correct position is the outermost) adjacent to the correct position, are stored as data in the memory of the printer 200. Then, based on this data, the position where the ink tank 1 is mounted is determined.

According to this processing, in the case of the magenta ink tank 1M, referring to the table, when light is emitted by the LED 101 for the magenta ink tank 1M, 323 mV is the amount of light emitted at the magenta position M; 67 mV is the amount of light emitted when the magenta ink tank 1M is at the cyan position C; and 68 mV is the amount of light emitted when the magenta ink tank 1M is at the yellow position Y. Since the amount of light emitted at the magenta position M is the maximum, it is determined that the magenta ink tank 1M is mounted correctly.

As described above, when an ink tank 1 is mounted at its correct position, the amount of light emitted at both adjacent positions (or one position when the correct position is the outermost) need only be compared with the amount of light emitted at the middle position. Since it is determined that the amount of light emitted at the middle position is the maximum, it is determined that the ink tank is correctly mounted.

The position detection processing will now be described for a case where the cyan ink tank 1C, the magenta ink tank 1M and the yellow ink tank 1Y are not correctly mounted.

Figure 5A:
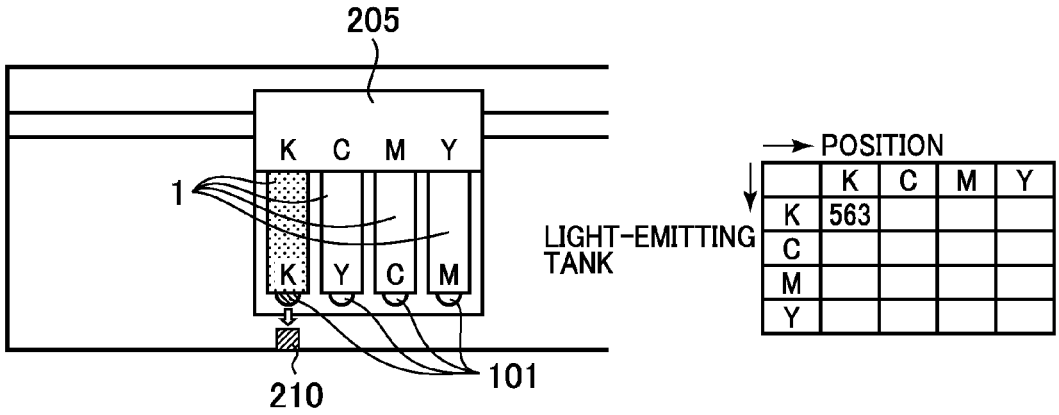
FIGS. 5A and 5B are diagrams showing the position detection processing according to the first embodiment of the invention.
Figure 5B:
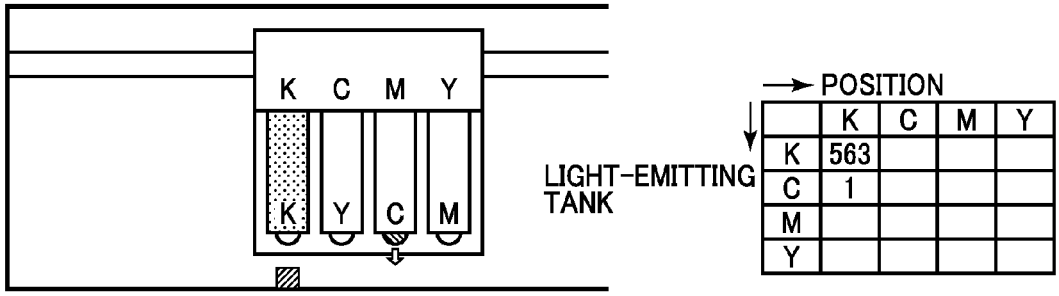

FIGS. 5A and 5B are diagrams showing the states where the carriage 205 has been moved so that the light receiving unit 210 faces the black position K. In the state in FIG. 5A, the LED 101 for the black ink tank 1K is turned on, and the amount of light received by the light receiving unit 210 is 563 mV. In the state in FIG. 5B, the LED 101 for the black ink tank 1K is turned off and the LED 101 for the cyan ink tank 1C is turned on. However, since the cyan ink tank 1C is incorrectly mounted at the magenta position M, a voltage of 1 mV is received by the light receiving unit 210. This voltage value is lower than the 14 mV that is an original received light voltage when the cyan ink tank 1C is correctly mounted at the cyan position C.

Figure 6A:
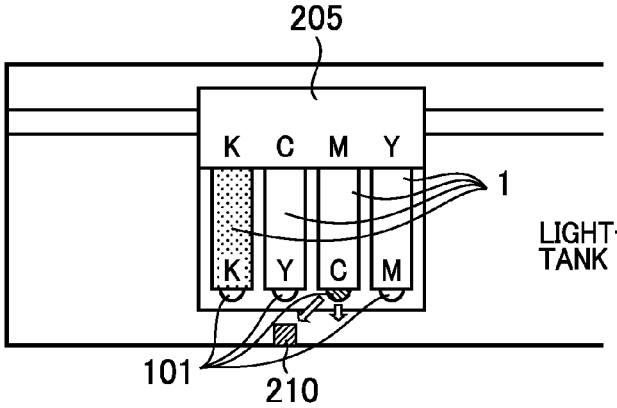
FIGS. 6A, 6B and 6C are diagrams showing the position detection processing according to the first embodiment of the invention.
Figure 6B:
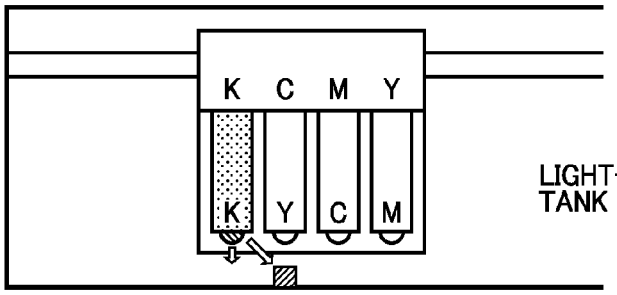
Figure 6C:
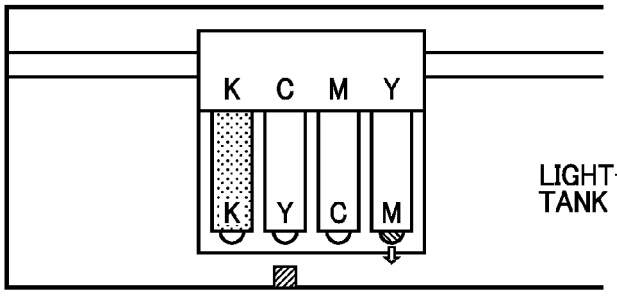

FIGS. 6A to 6C are diagrams showing the states wherein the position of the carriage 205 is shifted to the left a distance equivalent to one ink tank, i.e., the light receiving unit 210 faces the cyan position C. In the state in FIG. 6A, since the carriage 205 was moved while the LED 101 for the cyan ink tank 1C in FIG. 5B was on, the LED 101 for the cyan ink tank 1C is still on. However, since the cyan ink tank 1C is incorrectly mounted at the magenta position M, the light receiving unit 210 receives a voltage of 14 mV, which is lower than the 62 mV that is the originally received light voltage when the cyan ink tank 1C is mounted at the cyan position C. In the state in FIG. 6B, the LED 101 for the cyan ink tank 1C is turned off and the LED 101 for the black ink tank 1K is turned on. In the state in FIG. 6C, the LED 101 for the black ink tank 1K is turned off and the LED 101 for the magenta ink tank 1M is turned on.

Figure 7A:
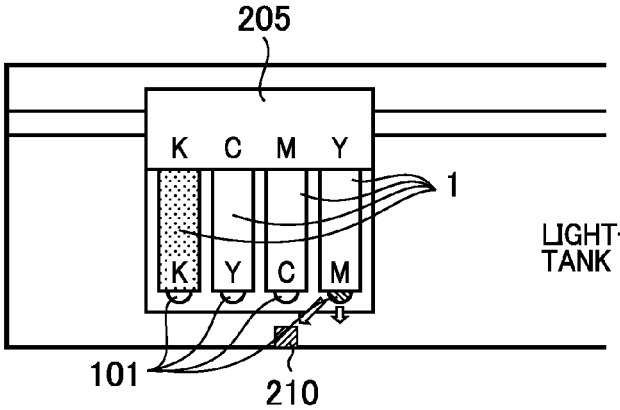
FIGS. 7A, 7B and 7C are diagrams showing the position detection processing according to the first embodiment of the invention.
Figure 7B:
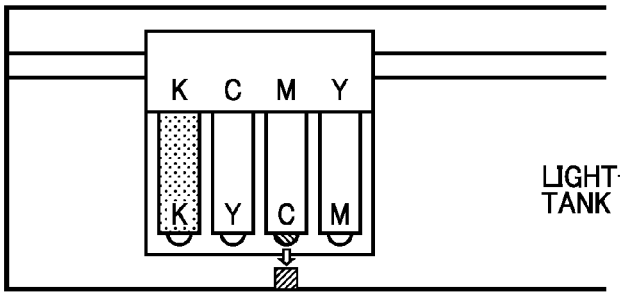
Figure 7C:
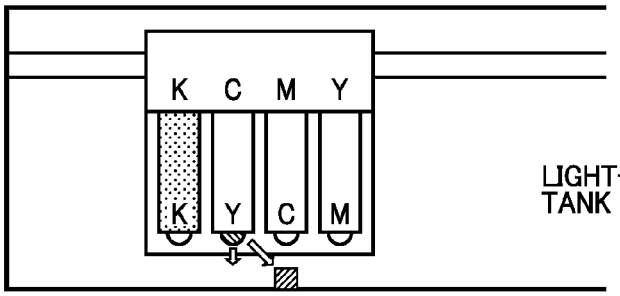
Figure 8A:
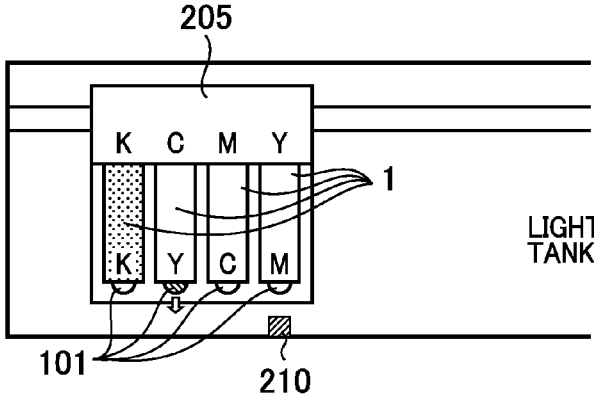
FIGS. 8A and 8B are diagrams showing the position detection processing according to the first embodiment of the invention.
Figure 8B:
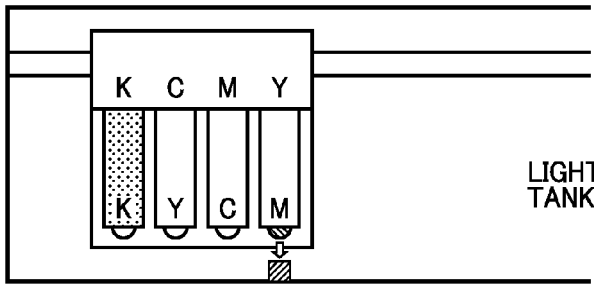

In FIGS. 7 and 8, in the same manner as in the above operation, the position of the carriage 205 is shifted to the left a distance equivalent to one ink tank, and for a specific ink tank, ink tanks that are supposed to be adjacently located when the specific ink tank is mounted at its correct position are alternately turned on. As a result, in accordance with the above described processing, in the case of the magenta ink tank 1M, referring to the tables in FIGS. 7 and 8, for example, 15 mV is the amount of light at the magenta position M when light emission is performed from the magenta ink tank 1M. 3 mV is the amount of light for the magenta ink tank 1M located at the cyan position C. And 323 mV is the amount of light for the magenta ink tank 1M located at the yellow position Y.

As previously described, the maximum amount of light for the magenta ink tank should be emitted at the magenta position. However, since that did not occur in the present case, it is determined that the magenta ink tank 1M is incorrectly mounted. As described above, when the amount of light emitted at the position where the ink tank is incorrectly mounted is compared with the amounts of light emitted at the adjacent positions (or at one adjacent position when the mounted position is the outermost), the amount of light at the middle position is not the maximum, and it can be determined that the ink tank is incorrectly mounted.

The received light voltage associated with the amount of light received by the light receiving unit 210 and the position where the ink tank 1 was incorrectly mounted are stored in the RAM (not shown) of the control circuit 300.

The operation for identifying the location of an ink tank 1 that is incorrectly mounted will now be explained.

Figure 9A:
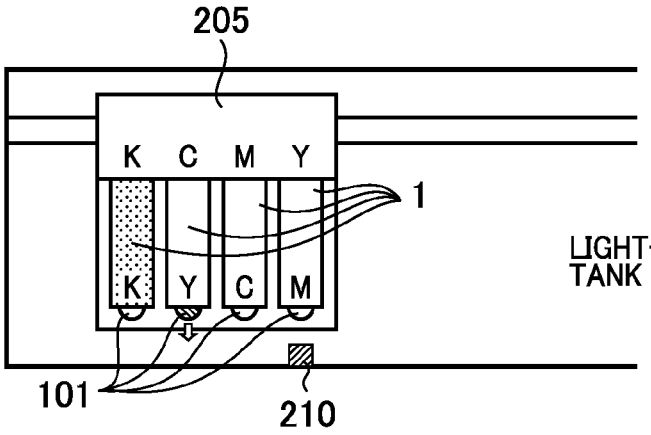
FIGS. 9A, 9B and 9C are diagrams showing the position detection processing according to the first embodiment of the invention.
Figure 9B:
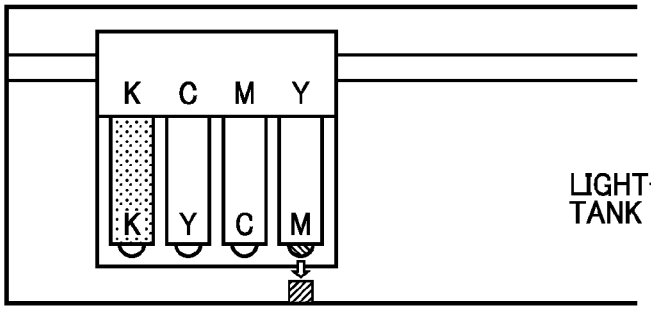
Figure 9C:
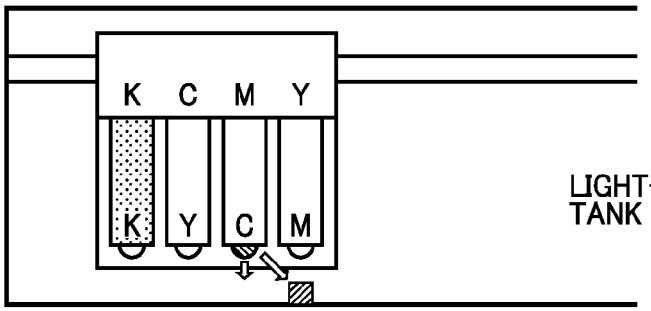

First, the carriage 205 is moved so that the ink tank 1 that is incorrectly mounted is moved to a location opposite the light receiving unit 210. In this embodiment, since the yellow ink tank 1Y is incorrectly mounted, it is not necessary to move the carriage 205 (the carriage 205 is maintained in the position as shown in FIGS. 9A to 9C) when the normal detection operation as described above has been ended. Following this, the ink tanks 1 incorrectly mounted are sequentially turned on. In this embodiment, as shown in FIGS. 9A to 9C, the LEDs 101 for the yellow, magenta and cyan ink tanks 1Y, 1M and 1C are turned on, and the amount of light emitted by each of them is measured and compared. At this time, since the maximum amount of light, 323 mV, was obtained when light emission was performed for the magenta ink tank 1M, it is determined that the magenta ink tank 1M is located at the yellow position M.

Figure 10A:
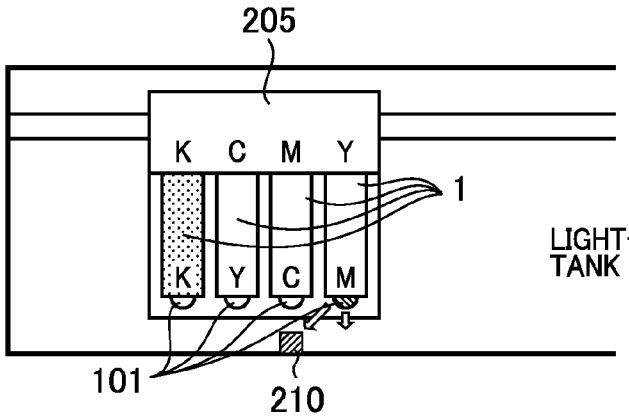
FIGS. 10A, 10B and 10C are diagrams showing the position detection processing according to the first embodiment of the invention.
Figure 10B:
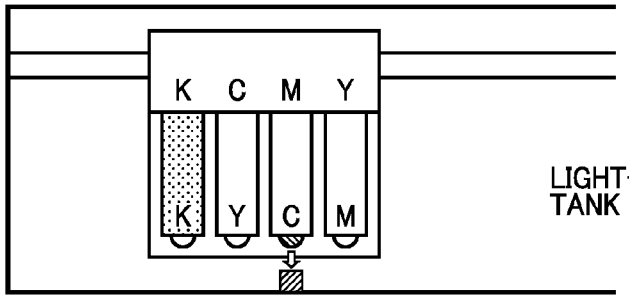
Figure 10C:
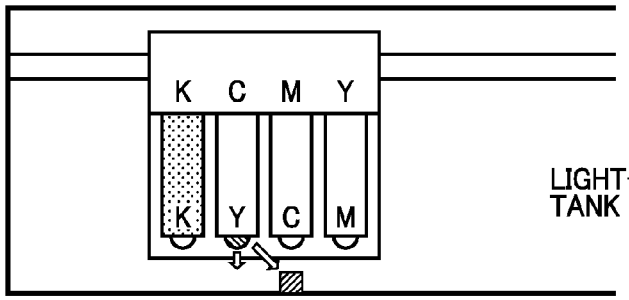

Since an ink tank 1 is also incorrectly mounted at the magenta position M, as shown in FIGS. 10A to 10C, the carriage 205 is moved so that the magenta position M is located opposite the light receiving unit 210. Then, in the same manner as previously described for determining the location of the ink tank 1 at the yellow position Y, the ink tanks 1 that are incorrectly arranged are sequentially turned on. As shown in FIGS. 10A to 10C, the LEDs 101 for the magenta, cyan and yellow ink tanks 1M, 1C and 1Y are turned on, and the amount of light emitted by each of them is measured and compared. At this time, since the maximum amount of light, 256 mV, was obtained when light emission for the cyan ink tank 1C was performed, it is determined that the cyan ink tank 1C is located at the magenta position M. Furthermore, it is determined that the remaining yellow ink tank 1Y is located at the cyan position C.

As described above, when the ink tanks 1 are correctly mounted, position identification can be completed in scan of the carriage 205. When the ink tanks 1 are incorrectly mounted, the positions where the ink tanks 1 are incorrectly mounted can be detected by a minimum number of carriage scans. Therefore, the period of time required to determine their locations can be drastically reduced.

Second Embodiment

In the first embodiment, to identify the positions where ink tanks are incorrectly mounted, the re-detection process is performed the number of incorrectly mounted positions less one. Further, the number of detection operations can also be reduced based on the amount of light obtained during the normal detection operation.

Figure 11:
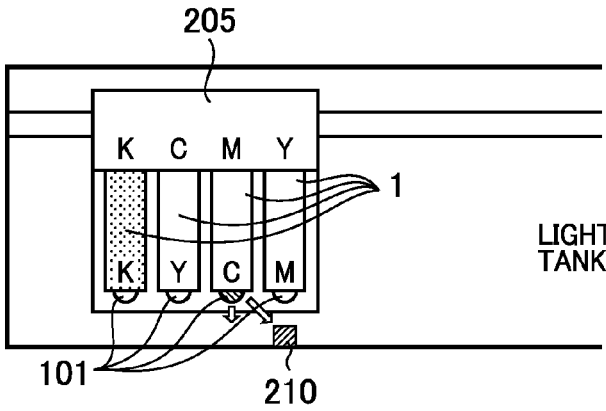
FIG. 11 is a diagram showing the position detection processing according to a second embodiment of the invention.

In the first embodiment, the yellow, magenta and cyan ink tanks 1Y, 1M and 1C are incorrectly mounted, and are alternately turned on when at the magenta position M. Because the data has been obtained in accordance with the operations described with respect to FIG. 10 in the first embodiment and has been stored in the RAM (not shown) of the control circuit 300, when the amount of light is detected by turning on the cyan ink tank 1C at the yellow position Y, all the material required for the determination can be obtained (the shaded portions in the table in FIG. 11 have already been stored in the RAM during the normal detection operation as described above).

As described above, based on the data obtained during the normal detection operation, the positions of the ink tanks that are incorrectly mounted are detected. Therefore, the locations of incorrectly mounted ink tanks can also be identified within the period of time required to detect whether the ink tanks are correctly mounted.

Third Embodiment

Figure 12A:
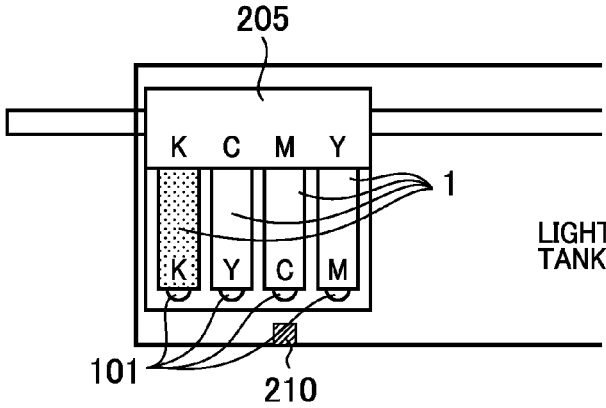
FIGS. 12A and 12B are diagrams showing the position detection processing according to a third embodiment of the invention.
Figure 12B:
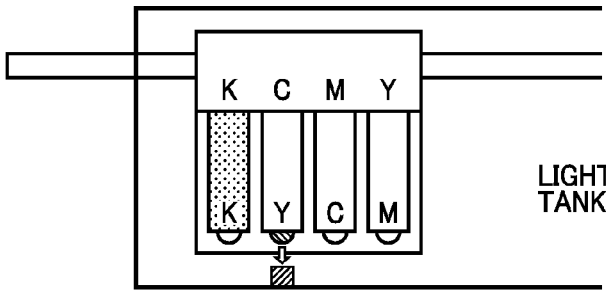

In the first and the second embodiments, each of the ink tanks 1 can be moved to locations opposite the light receiving unit 210. However, because of the size of the printer's main body, not all ink tanks 1 may be moved to a location opposite the light receiving unit 210. In this embodiment, for example, as shown in FIGS. 12A to 12B, a yellow position Y at one end of the carriage 205 can not be shifted to a location opposite a light receiving unit 210. The position detection processing for the case where ink tanks are incorrectly mounted and not all ink tanks can be moved to a location opposite the light receiving unit 210 will be explained with reference to FIGS. 12A to 12B.

Since the operation for detecting a black position K, a cyan position C and a magenta position M is the same as that described above with respect to the first embodiment, a detailed description herein is omitted. In the state shown in FIG. 12A, the normal detection operation has been completed. The black ink tank 1K is identified at the black position K, at the cyan position, the maximum amount of light emitted is identified as being from the black ink tank 1K, and at the magenta position, the maximum amount of light emitted is identified as being from the cyan ink tank 1C. Thus, since the position of the black ink tank 1K has already been identified, it can be determined that the black ink tank 1K is not located at the cyan position C and that the cyan ink tank is incorrectly mounted at the magenta position M.

The remaining unidentified positions are the cyan C and yellow Y positions, and when the ink tank at the cyan position C is identified, the location of the ink tank at the yellow position Y is automatically determined.

In order to identify an ink tank at the cyan position C, as shown in FIG. 12B, the carriage 205 is moved so that the cyan position C is positioned opposite the light receiving unit 210, and the LED 101 of the yellow ink tank 1Y emits light. At this time, the amount of light emitted reaches the maximum, 560 mV, and it can be determined that the yellow ink tank 1Y is mounted at the cyan position C. Accordingly, it is also determined the magenta ink tank 1M is mounted at the yellow position Y.

As described above, for the arrangement wherein information for one ink tank can not be obtained, both the ink tank for which information can not be obtained and at least another ink tank are sequentially processed during the operation for turning on the LEDs 101 for the ink tanks for which the locations are unknown. In this manner, the types of ink tanks that are mounted at all the positions can be identified.

According to the configuration of the present invention, as a carriage wherein a plurality of ink tanks are mounted is moved, the light emitting units for the ink tanks emit light at a predetermined location, and the light emitted at this location is detected. With this arrangement, when the ink tanks are correctly mounted, position detection can be performed within a short period of time. And when there are ink tanks that are incorrectly mounted, only ink tanks for which positions can not be identified are halted at those locations, and light is emitted for these ink tanks to detect their positions. Thus, the accuracy with which detection is performed can be improved, and the period of time required for detection can be considerably reduced.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. A recording apparatus comprising:

a movable carriage having a plurality of mounting positions respectively corresponding to a plurality of liquid containers each having a light emitting portion, the mounting positions being arranged in a moving direction of the carriage;

a light receiving portion capable of receiving light emitted from light emitting portions of the liquid containers mounted at the mounting positions;

determining means for determining whether the liquid containers are respectively mounted at correct mounting positions, based on light receiving results, of the light receiving portion, of light emitted from the light emitting portions of the liquid containers mounted at the mounting positions; and specifying means for specifying a liquid container mounted at one of mounting positions corresponding to liquid containers determined not to be mounted at the correct mounting positions by the determining means, based on light reception results, of the light receiving portion, of light sequentially emitted from the light emitting portions of the liquid containers determined not to be mounted at the correct mounting positions in a state that the one mounting position faces the light receiving portion.

2. The recording apparatus according to claim 1, wherein the light receiving results used in the determining means are light receiving results of light emitted from the light emitting portions changed depending on positions of the carriage in the moving direction.

3. A recording apparatus comprising:

a movable carriage having a plurality of mounting positions respectively corresponding to a plurality of liquid containers each having a light emitting portion, the mounting portions being arranged in a moving direction of the carriage;

a light receiving portion capable of receiving light emitted from light emitting portions of the liquid containers mounted to the mounting portions;

determining means for determining whether the liquid containers are respectively mounted to the corresponding mounting portions, based on light receiving results, of the light receiving portion, of light emitted from the light emitting portions changed depending on positions of the carriage in the moving direction; and specifying means for specifying, in response to a determination of the determining means that there are incorrect liquid containers which are not mounted to the corresponding mounting portions, an incorrect liquid container mounted to a certain mounting portion of mounting portions corresponding to the incorrect liquid containers, wherein the specifying means specifies the incorrect liquid container mounted to the certain mounting portion, based on light reception results, of the light receiving portion, of light sequentially emitted from the light emitting portions of the incorrect liquid containers in a state that the carriage stops at a position where the certain mounting portion faces the light receiving portion.

4. The recording apparatus according to claim 3, wherein the light receiving results used in the determining means include a first light receiving result of light emitted from the light emitting portion of one liquid container containing ink of a particular color in a state that a predetermined mounting portion corresponding to the one liquid container faces the light receiving portion and a second light receiving result of light emitted from the light emitting portion of the one liquid container in a state that an adjacent mounting portion adjacent to the predetermined mounting portion faces the light receiving portion, and wherein the determining means determines whether the one container is mounted to the predetermined mounting portion based on the first and second light receiving results.

5. A liquid container specifying method for a recording apparatus that includes a moveable carriage having a plurality of mounting positions corresponding to a plurality of liquid containers, each having a light emitting portion and a light receiving portion capable of receiving light emitted from the light emitting portions of the plurality of liquid containers mounted at the plurality of mounting positions, the method comprising:

determining whether the liquid containers are respectively mounted at correct mounting positions, based on light receiving results, of the light receiving portion, of light emitted from the light emitting portions of the liquid containers mounted at the mounting positions; and specifying a liquid container mounted at one of mounting positions corresponding to liquid containers determined not to be mounted at the correct mounting positions, based on light reception results, of the light receiving portion, of light sequentially emitted from the light emitting portions of the liquid containers determined not to be mounted at the correct mounting positions in a state that the one mounting position faces the light receiving portion.

* * * * *